US010703123B2

(12) United States Patent
Herlambang et al.

(10) Patent No.: US 10,703,123 B2
(45) Date of Patent: Jul. 7, 2020

(54) INK JET RECORDING MEDIUM AND IMAGE RECORDING METHOD

(71) Applicant: CANON KABUSHIKI KAISHA, Tokyo (JP)

(72) Inventors: Olivia Herlambang, Kawasaki (JP); Yoshiyuki Nagase, Kawasaki (JP); Masaya Asao, Yokohama (JP); Takeshi Ota, Ebina (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/927,759

(22) Filed: Mar. 21, 2018

(65) Prior Publication Data

US 2018/0281383 A1 Oct. 4, 2018

(30) Foreign Application Priority Data

Mar. 28, 2017 (JP) ..... 2017-063413

(51) Int. Cl.
*B41M 5/52* (2006.01)
*B41M 5/50* (2006.01)

(52) U.S. Cl.
CPC ..... *B41M 5/52* (2013.01); *B41M 5/502* (2013.01); *B41M 5/5218* (2013.01); *B41M 5/5254* (2013.01); *B41M 5/5272* (2013.01); *B41M 5/5281* (2013.01); *B41M 5/5263* (2013.01)

(58) Field of Classification Search
CPC ..... B41M 5/52
USPC ..... 428/32.2
See application file for complete search history.

(56) References Cited

U.S. PATENT DOCUMENTS

2001/0016249 A1* 8/2001 Kitamura ..... B41M 5/5218 428/32.34
2002/0044186 A1 4/2002 Tochihara et al.
2007/0231511 A1* 10/2007 Okuda ..... B41M 5/52 428/32.34
2015/0301483 A1* 10/2015 Noguchi ..... G03G 15/162 347/1
2015/0368489 A1* 12/2015 Satou ..... B41M 5/502 428/143
2016/0271986 A1* 9/2016 Nagase ..... B41M 5/502
2017/0282630 A1* 10/2017 Nagase ..... B41M 5/50

FOREIGN PATENT DOCUMENTS

DE 102016103652 A1 9/2016
EP 0741045 A1 11/1996
EP 3069895 A1 9/2016
EP 3075560 A2 10/2016
JP 2006051741 A 2/2006
JP 2006110787 A 4/2006
JP 2008105235 A 5/2008
JP 2016172439 A 9/2016

* cited by examiner

*Primary Examiner* — Shelby L Fidler
(74) *Attorney, Agent, or Firm* — Canon U.S.A., Inc. IP Division

(57) ABSTRACT

An ink let recording medium includes a substrate and an ink-receiving layer as the uppermost surface layer, with the ink-receiving layer containing inorganic particles mainly including alumina particles, and a binder mainly containing a water-insoluble resin, wherein the content of the inorganic particles is 50% by mass or more relative to the total mass of the ink-receiving layer and the surface roughness (Ra) of the ink-receiving layer measured with a scanning probe microscope is in the range of 30 nm to 150 nm.

14 Claims, 1 Drawing Sheet

INK JET RECORDING MEDIUM AND IMAGE RECORDING METHOD

BACKGROUND

Field of the Disclosure

The present disclosure relates to an ink jet recording medium and an image recording method.

Description of the Related Art

Recorded articles produced by recording an image on a recording medium may be displayed outdoors in some cases. When a recorded article including an image formed with an ink is displayed outdoors, the recorded article is often coated with a laminate (subjected to lamination) to reduce the impact of rain and wind. However, applying a lamination increases cost and the number of process steps.

Accordingly, a recording medium that can reduce the impact of rain and wind on recorded images without being coated with a laminate is desired. For example, from the viewpoint of enhancing water resistance, recording media (or recording media) including an ink-receiving layer containing a water-insoluble resin, such as acrylic resin or urethane resin, are known (Japanese Patent Laid-Open Nos. 2016-172439, 2008-105235, 2006-110787, and 2006-051741).

However, the present inventors have found, through their studies, that when the recording medium disclosed in Japanese Patent Laid-Open No. 2016-172439, which exhibits a high ink absorption and has a high water resistance, is recorded with pigment ink, the recorded article may not be satisfactory color-developed in some cases. The recording media disclosed in Japanese Patent Laid-Open Nos. 2008-105235 and 2006-11.0787 include an uppermost surface layer containing a water-insoluble resin to improve the water resistance of the recording media. However, the level of the water resistance is still insufficient. If pigment ink is used for recording an image to be displayed outdoors, the pigment of the ink flakes from the recording medium sometimes. The recording medium disclosed in Japanese Patent Laid-Open No. 2006-051741 improves upon water resistance, but the water absorption remains lacking. If pigment ink is used for recording an image to be displayed outdoors, the pigment of the ink often flakes from the recording medium.

SUMMARY

The present disclosure is directed to an ink jet recording medium exhibiting high ink absorption, enabling high color development, having a high water resistance, and reducing flaking of pigment and to a method for recording an image on the ink jet recording medium.

According to an aspect of the present disclosure, there is provided an ink jet recording medium including a substrate and an ink-receiving layer that is the uppermost surface layer of the recording medium. The ink-receiving layer contains inorganic particles mainly including alumina particles, and a binder mainly containing a water-insoluble resin. The content of the inorganic particles is 50% by mass or more relative to the total mass of the ink-receiving layer. The surface roughness of the ink-receiving layer measured with a scanning probe microscope is in the range of 30 nm to 150 nm.

According to another aspect of the present disclosure, an image recording method is provided which includes ejecting an aqueous pigment ink onto the above-described ink jet recording medium from a recording head.

Further features of the present disclosure will become apparent from the following description of exemplary embodiments with reference to the attached drawings.

DESCRIPTION OF THE EMBODIMENTS

Figure 1:
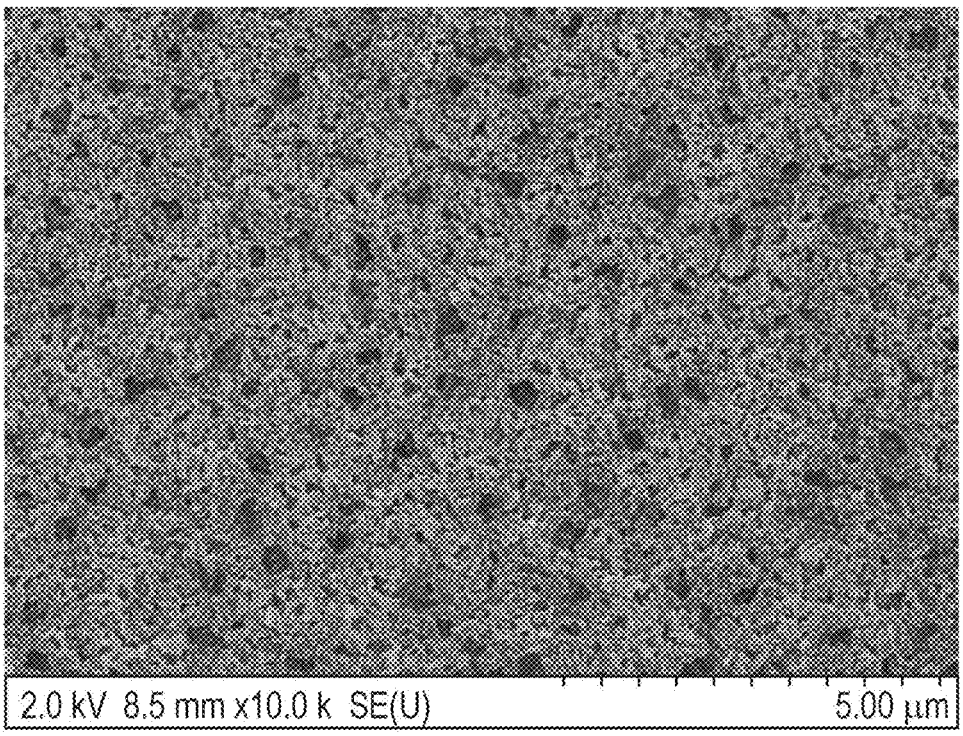
FIG. 1 is a micrograph of the surface of recording medium 6 in Example 6, according to one or more aspect of the subject disclosure, taken by a scanning electron microscope.

The subject matter of the present disclosure will be described in detail in the following exemplary embodiments. It should be noted that the ink jet recording medium disclosed herein may be simply referred to as "recording medium". Also, the pigment contained as a coloring material in ink may be simply referred to as "pigment". Also, the uppermost surface layer may be referred to as "top layer" or simply referred to as "surface layer".

The present inventors have researched why images recorded with ink on recording media deteriorate when displayed outdoors and found that the following two major reasons may be the culprits: One being that rainwater dissolves the water-soluble resin in the ink-receiving layer and thus removes the ink-receiving layer from the recording media; and the other, that the pigment is flaked from the surface of the ink-receiving layer by the impact of rain and wind. Therefore, a further measure to prevent the pigment from flaking off is desired for suppressing the deterioration of images displayed outdoors, in addition to the idea of adding a water-insoluble resin in the ink-receiving layer to enhance the water resistance as disclosed in the above-cited prior art documents. The present inventors have found that the flaking of pigment can be prevented by controlling the surface roughness of the uppermost surface layer, or the ink-receiving layer, in a specific range. The reason is explained below.

When a recorded article produced by recording an image on a recording medium is displayed outdoors, it is beneficial to use aqueous pigment ink (hereinafter simply referred to as pigment ink) containing a pigment having good color fastness to water so as to prevent the coloring material from dissolving in rainwater. Even though pigment ink is used, however, if the adhesion of the pigment in the pigment ink to the surface of the ink-receiving layer is insufficient, the pigment may be flaked by the impact of rain and wind. The present inventors have found through their researches that the flaking of the pigment can be relieved by controlling the surface roughness of the ink-receiving layer being the uppermost surface layer (the surface of the recording medium at which the ink-receiving layer is disposed). More specifically, it has been found that the flaking of the pigment can be reduced by controlling the surface roughness Ra of the recording medium in the range of 30 nm to 150 nm, and that the recorded articles including an image recorded with the pigment ink on such a recording medium has a satisfactory fastness.

In order to reduce the flaking of pigment, it is particularly important to control the surface roughness of the uppermost ink-receiving layer of the recording medium to the order of nanometers, not micrometers. According to the findings of the present inventors, the ink-receiving layer having a very small surface roughness of the order of nanometers have what is called anchor effect, which is the effect of retaining the pigment of pigment ink on the surface of the recording medium, larger than the ink-receiving layer having a micrometer order surface roughness. The nanometer-order very small surface roughness of the ink-receiving layer mentioned herein is measured with a scanning probe microscope (SPM). The scanning probe microscope may also be called atomic force microscope (AFM).

If the surface roughness Ra of the ink-receiving layer is less than 30 nm, the anchor effect of the ink-receiving layer on the pigment in pigment ink is insufficient, and the pigment is likely to flake from the surface of the ink receiving layer.

Also, when the surface roughness Ra. of the ink-receiving layer is larger than 150 nm, light scattering from the surface of the recording medium increases, and accordingly, color development is reduced. The present inventors assume that the reason of reduced color developability is that if the surface roughness Ra is large, the pigment in pigment ink trapped in deep depressions in the surface of the recording medium is affected by the binder in the ink-receiving layer. In particular, the ink-receiving layer made of a water-insoluble resin emulsion tends to be less transparent. If the pigment is trapped deep in the ink-receiving layer, the color development of the pigment is further reduced. Accordingly, in the present disclosure, the surface roughness Ra of the ink-receiving layer is controlled to 150 nm or less from the viewpoint of preventing insufficient color development as well as reducing the flaking of the pigment.

The binder in the ink-receiving layer disclosed herein mainly contains a water-insoluble resin. The water-insoluble resin enhances the water resistance of the ink-receiving layer and, in addition, can produce an interaction with the pigment in pigment ink to enhance the anchor effect of the ink-receiving layer on the pigment.

The ink-receiving layer contains inorganic particles with a content of 50% by mass or more relative to the total mass of the ink-receiving layer, consequently having a porosity sufficient to have a satisfactory ink absorbency. From the viewpoint of reducing cracks even in the ink-receiving layer containing inorganic particles with a large content, the inorganic particles may mainly include alumina particles. Alumina particles are good in forming a film or layer, and the use of alumina particles results in a highly ink-absorbent ink-receiving layer. The term ink absorbency used herein refers to absorbency to aqueous ink.

Synergistic interaction between components of the ink jet recording medium as described above produces beneficial effects to a significant extent, that is, effects of increasing ink absorbency, color development, and water resistance and reducing the flaking of pigment.

Recording Medium

The components of the ink jet recording medium will now be described.

Substrate

The substrate may be a known substrate that can be used as or for recording media or any other substrate that can function to support the ink-receiving layer and is not otherwise limited. The substrate may be composed of only a base paper, only a plastic film, or only cloth. Alternatively, the substrate may have a multilayer structure. For example, such a substrate may be a type including a base paper and a resin layer, that is, a resin-coated substrate. In some embodiments, the substrate may be a resin-coated substrate, a plastic film, or a cloth sheet from the viewpoint of using the recording medium for outdoor display.

The substrate may have a thickness in the range of 50 μm to 400 μm, such as in the range of 70 μm to 200 μm. The thickness of the substrate used herein is determined according to the following procedure. First, the recording medium is cut to expose a section with a microtome, and the section is observed under a scanning electron microscope. Then, the thickness of the substrate is measured at 1.00 or more randomly selected points, and the average of the measured thicknesses is defined as the thickness of the substrate. The thickness of other layers used herein is also determined in the same manner.

(1) Resin-Coated Substrate

Base Paper

The base paper is mainly made of wood pulp, and may optionally contain a synthetic pulp, such as polypropylene, or a synthetic fiber, such as nylon or polyester. Exemplary wood pulp include leaf bleached kraft pulp (LBKP), leaf bleached sulfite pulp (LBSP), needle bleached kraft pulp (NBKP), needle bleached sulfide pulp (NESP), leaf dissolving pulp (LDP), needle dissolving pulp (NDP), leaf unbleached kraft pulp (LUKP), and needle unbleached kraft pulp (NUKP). These may be used singly or in combination. LBKP, LBSP, NBSP, LDP, and NDP, which contain a large amount of short fibers, are beneficial. Pure chemical pulp, such as sulfate pulp or sulfite pulp, is also advantageous. Pulps bleached to increase the whiteness are also beneficial. The base paper may further contain a sizing agent, a white pigment, a reinforcing agent, a fluorescent brightening agent, a moisturizing agent, dispersant, a softening agent, or the like, if necessary.

The base paper may have a thickness in the range of 50 μm to 130 μm, such as in the range of 90 μm to 120 μm. The thickness of the base paper used herein is determined in the same manner as the thickness of the substrate.

The density of the base paper specified in JIS P 8118 may be in the range of 0.6 g/cm$^3$ to 1.2 g/cm$^3$, such as in the range of 0.7 g/cm$^3$ to 1.2 g/cm$^3$.

Resin Layer

The resin layer may be formed on one side of the base paper or on both sides. In some embodiments, the resin layer may be disposed on both sides of the base paper. If the base paper is coated with a resin layer, the resin layer may cover a portion of the surface of the base paper. The percentage of the resin layer covering the base paper ((area of the surface of the base paper covered with the resin layer)/(entire area of the surface of the base paper) may be 70% or more, such as 90% or more. Beneficially, it is 100%; hence, it is beneficial that the entire surface of the base paper is covered with the resin layer.

The resin layer may have a thickness in the range of 20 μm to 60 μm, such as in the range of 35 μm to 50 μm. If the resin layer is formed on both sides of the base paper, it is beneficial that the thickness of each resin layer is in such a range.

In some embodiments, the resin layer may be made of a thermoplastic resin. Examples of the thermoplastic resin include acrylic resin, acrylic silicone resin, polyolefin resin, and styrene-butadiene copolymer. In some embodiments, polyolefin resin may be used. The polyolefin resin mentioned herein refers to a polymer using an olefin as a monomer. More specifically, the polyolefin resin may be a homopolymer or copolymer of one or more monomers such as ethylene, propylene, and isobutylene. These may be used singly or in combination. In some embodiments, the polyolefin may be polyethylene. The polyethylene may be a low density polyethylene (LDPE) or a high density polyethylene (HDPE).

The resin layer may contain a white pigment, a fluorescent brightening agent, or a bluing agent, such as ultramarine blue, to adjust opacity, whiteness, or hue. In some embodiments, a white pigment may be added to increase the opacity of the recording medium. The white pigment may be titanium oxide in the form of rutile or anatase. If a white pigment is used, the white pigment content in the resin layer may be in the range of 3 $g/m^2$ to 30 $g/m^2$. If the resin layer is formed on both sides of the base paper, the total of the white pigment content in each resin layer may be in this range. In addition, the proportion of the white pigment may be 25% by mass or less relative to the resin in the resin layer. If the proportion of the white pigment is higher than 25% by mass, the white pigment may not be able to be stably dispersed.

The arithmetic average surface roughness Ra specified in JIS B 0601: 2001 of the resin layer may be in the range of 0.12 μm to 0.18 μm, such as in the range of 0.13 μm to 0.15 μm. The mean width of the roughness profile elements, Rsm, specified in JIS B 0601: 2001 of the resin layer may be in the range of 0.01 mm to 0.20 mm, such as in the range of 0.04 mm to 0.15 mm.

(2) Plastic Film

The plastic of the plastic film used herein refers to that containing 50% by mass or more of polymer having a weight average molecular weight of 10,000 or more, and the plastic film refers to a film formed of the plastic. The plastic used in the plastic film is thermoplastic. Exemplary thermoplastic plastics include vinyl-based plastics, polyester-based plastics, cellulose ester-based plastics, polyamide-based plastics, and heat-resistant engineering plastics.

Vinyl-based plastics include polyethylene, polyvinyl chloride, polyvinylidene chloride, polyvinyl alcohol, polystyrene, polypropylene, and fluororesin. Polyester-based plastics include polycarbonate and polyethylene terephthalate. Cellulose ester-based plastics include cellulose diacetate, cellulose triacetate, and cellulose acetate butyrate. Polyamide-based plastics include nylon 6, nylon 66, and nylon 12. Heat-resistant engineering plastics include polyimide, polysulfone, polyethersulfone, polyphenylene sulfide, poly(ether ketone), and polyether imide. These and those may be used singly or in combination. In some embodiments, polyvinyl chloride, polypropylene, polycarbonate, or polyethylene terephthalate may be used from the viewpoint of durability and cost.

In an embodiment, a synthetic paper produced by treating the plastic with a chemical, coating the surface of the plastic, or adding a substance into the plastic to increase opacity may be used as the plastic film. For the treatment with a chemical, the surface of the plastic may be dipped in an organic solvent, such as acetone or methyl isobutyl ketone, to form a swelled layer, and the swelled layer is dried and solidified with another organic solvent, such as methanol. For the surface coating, a layer containing a white pigment, such as calcium carbonate or titanium oxide, and a binder may be formed over the surface of the plastic. For the addition into the plastic, a pigment, such as calcium carbonate, titanium oxide, zinc oxide, white carbon, clay, talc, or barium sulfate, may be added as a filler. A foamed plastic film having a high opacity may be used. Formed plastic is produced by adding polybutylene terephthalate particles, polycarbonate particles, polyester resin, or polycarbonate resin into plastic to form pores in the plastic, thus increasing the opacity.

The plastic film used herein may have a thickness in the range of 50 μm to 300 μm, such as in the range of 75 μm to 135 μm.

The plastic of the plastic film may have a glass transition temperature (Tg) in the range of −20° C. to 150° C., such as in the range of −20° C. to 80° C. Glass transition temperature may be measured by differential scanning calorimetry (DSC).

The density of the plastic film specified in JIS K 7112: 1999 may be in the range of 0.6 g % $cm^3$ to 1.5 $g/cm^3$, such as in the range of 0.7 $g/cm^3$ to 1.4 $g/cm^3$.

The water absorption of the plastic film specified in JIS K 7209: 2000 may be 5% or less, such as 1% or less.

The plastic film may be subjected to surface oxidation to enhance the adhesion thereof with the ink-receiving layer. Examples of the surface oxidation include corona discharge, flame treatment, plasma treatment, glow discharge, and ozone treatment. One of these methods may be applied, or two or more methods may be combined. In some embodiments, the surface oxidation may be performed by ozone treatment. The ozone treatment may be performed at a power in the range of 10 $W \cdot min/m^2$ to 200 $W \cdot min/m^2$, such as in the range of 50 $W \cdot min/m^2$ to 150 $W \cdot min/m^2$.

(3) Cloth

The cloth used herein is in the form of a thin, large sheet or plate containing a large number of fibers. The material of the fibers may be natural fiber, regenerated fiber recycled from a plastic or a material having properties similar to natural fiber, or synthetic fiber made from a polymer such as petroleum. Examples of the natural fiber include cotton fiber, silk fiber, hemp or linen fiber, mohair fiber, wool fiber, and cashmere fiber. Examples of the regenerated fiber include acetate fiber, cuprammonium rayon fiber, rayon fiber, or recycled polyester fiber. Examples of the synthetic fiber include nylon fiber, polyester fiber acrylic fiber, vinylon fiber, polyethylene fiber, polypropylene fiber, polyimide fiber, and polyurethane fiber.

Ink-Receiving Layer

The ink-receiving layer that is the uppermost surface layer of the recording medium (hereinafter sometimes referred to as the uppermost ink-receiving layer) disclosed herein contains inorganic particles and a binder. The inorganic particle content in the ink-receiving layer is 50% by mass or more relative to the total mass of the ink-receiving layer, and the inorganic particles mainly include alumina particles. The binder mainly contains a water-insoluble resin. The expression "the inorganic particles mainly include alumina particles" implies that alumina particles account for 50% by mass or more of the total mass of the inorganic particles in the ink-receiving layer. The expression "the binder mainly contains a water-insoluble resin" implies that the water-insoluble resin accounts for 50% by mass or more of the total mass of the binder in the ink-receiving layer.

The ink-receiving layer may be disposed on either or both sides of the substrate. Also, the ink-receiving layer may be defined by a single layer or two or more layers. If the ink-receiving layer has a multilayer structure including two or more layers, the uppermost layer of the multilayer structure contains the inorganic particles mainly including alumina particles, and the binder mainly containing a water-insoluble resin.

The inorganic particle content in the ink-receiving layer may be determined according to the following procedure. First, 10 g of the ink-receiving layer is scraped from the recording medium and heated at 600° C. for 2 hours, and the residue is weighed (Y g). The Y at this time corresponds to the inorganic particle content; hence, the inorganic particle content in the ink-receiving layer is Y (g)/10 (g). In the recording medium disclosed herein, the value of Y/10 is 50% or more.

In the recording medium disclosed herein, the uppermost ink-receiving layer has a surface roughness Ra in the range of 30 nm to 150 nm when measured with an SPM. In some embodiments, the surface roughness Ra of the uppermost ink-receiving layer, measured with an SPM may be in the range of 35 nm to 150 nm, such as in the rage of 40 nm to 150 nm or 40 nm to 100 nm.

In addition, in some embodiments, the surface of the recording medium has depressions having a circle equivalent diameter in the range of 240 nm to 800 nm when viewed from above, and the number of such depressions may be in the range of 50/100 $\mu m^2$ to 300/100 $\mu m^2$, such as in the range of 60/100 $\mu m^2$ to 300/100 $\mu m^2$, in view of the ink absorbency and water resistance of the recording medium. The images of the surface of the recording medium taken by a scanning electron microscope can be processed and analyzed by using an image analysis software program, such as Photoshop (produced by Adobe Systems) or WinROOF (produced by Mitani Corporation).

The present inventors have found that the number of depressions having a circle equivalent diameter in the range of 240 nm to 800 nm in the surface of the recording medium affects the ink absorbency and the water resistance of the recording medium. The present inventors assume that the relationship between the depressions having a circle equivalent diameter in the range of 240 nm to $00 nm and the ink absorbency or the water resistance is as below.

The depressions in the surface of the recording medium result from the resin (resin particles) contained in the coating liquid for the ink-receiving layer. More specifically, the resin in the coating liquid is dissolved by heating for drying the coating liquid applied onto the substrate. The dissolved resin migrates to pores or air gaps into the inorganic particles in the coating liquid, thereby forming air gaps at the positions where the resin has previously been present.

Also, a relatively large amount of resin is present at the surfaces defined by these depressions. Therefore, when a water-insoluble resin is used as the resin, the depressions are less absorbent to ink and rain water than the portion other than depressions. The present inventors have studied the relationship between the size of the depressions and each of ink absorbency and water resistance and found that the number of depressions having a circle equivalent diameter in the range of 240 nm to 800 nm is important. More specifically, it has been found that when the circle equivalent diameter of the depressions is in the range of 50/100 $\mu m^2$ or more, high water resistance can be exhibited, and that when the circle equivalent diameter is in the range of 300/100 $\mu m^2$ or less, high ink absorbency can be exhibited. The reason for this is not clear, but there may be some relationship among the size of ink droplets, the size of rain water droplets, and the range of the circle equivalent diameter of the depressions resulting from water-insoluble resin.

Since it is assumed that the depressions are formed by the resin in the coating liquid for the ink-receiving layer, as described above, the number of depressions having a circle equivalent diameter in the range of 240 nm to 800 nm can be controlled as desired by varying the average particle diameter or the particle diameter distribution of the resin in the coating liquid.

The thickness of the ink-receiving layer depends on the capacity or the like of ink absorption required thereof and may be 25 μm or more. The ink-receiving layer with a thickness of 25 μm or more can satisfy the ink absorption required thereof. The upper limit of the thickness of the ink-receiving layer is not particularly limited unless causing cracks, and it may be 50 μm or less from the viewpoint of preventing cracks.

The thickness of the ink-receiving layer may be measured by observing the section of the recording medium, which may be taken by cutting the medium with a microtome or the like, under a scanning electron microscope (SEM).

Inorganic Particles

The ink-receiving layer contains inorganic particles. The content of the inorganic particles is preferably 60% by mass or more, and more preferably 70% by mass or more relative to the total mass of ink-receiving layer from the viewpoint of ink absorbency. Also, the content of the inorganic particles is preferably 98% by mass or less, and more preferably 96% by mass or less relative to the total mass of ink-receiving layer from the viewpoint of reducing cracks. The ink-receiving layer contains alumina particles as inorganic particles. In addition, the ink-receiving layer may contain inorganic particles other than alumina particles. Inorganic particles are described below.

(1) Alumina Particles

The inorganic particles contained in the ink-receiving layer disclosed herein are mainly alumina particles. In some embodiments, the alumina particles may be those of hydrated alumina.

The hydrated alumina used in the ink-receiving layer may be represented by the following general formula:

$$Al_2O_{3-n}(OH)_{2n}.mH_2O$$

(n represents 0, 1, 2, or 3, m represents a number of 0 to 10, beneficially 0 to 5, and m and n are not simultaneously 0.) $mH_2O$ represents an aqueous phase that can be desorbed and is often not involved in the formation of crystal lattices, and m is therefore not necessarily integer. Also, m may be reduced to 0 by heating the hydrated alumina.

The alumina particles may be produced in a known process. More specifically, the alumina particles may be produced by hydrolysis of aluminum alkoxide, by hydrolysis of sodium aluminate, or by adding an aqueous solution of aluminum sulfate or aluminum chloride to a sodium aluminate aqueous solution to neutralize the sodium aluminate solution.

The alumina particles may be amorphous or have a crystal structure in the form of gibbsite or boehmite, depending on the temperature of heat treatment. Any of these forms may be used. In some embodiments, alumina particles determined to be boehmite or amorphous by X-ray diffraction analysis may be beneficially used.

In some embodiments, the alumina particles may be used in the form of a dispersion liquid for being mixed in the coating liquid for forming the ink-receiving layer. In this instance, an acid may be used as a dispersant of the dispersion liquid. The acid may be a sulfonic acid represented by the following general formula (Y): $R—SO_3H$ (R represents hydrogen, an alkyl group having a carbon number of 1 to 3, or an alkenyl group having a carbon number of 1 to 3, and R may have an oxo group, a halogen atom, an alkoxy group, or an acyl group as a substituent.) Such a sulfonic acid can reduce bleeding in the recorded image and is thus beneficial.

In some embodiments, the alumina particles added to the ink-receiving layer may have a specific particle diameter from the viewpoint of enabling the recording medium to have the surface roughness Ra specified herein. More specifically, the average particle diameter of the alumina particles may be in the range of 155 nm to 560 nm and beneficially in the range of 160 nm to 560 nm, such as in the range of 170 nm to 540 nm or 190 nm to 250 nm.

The average particle diameter of the alumina particles may be measured by a light scattering method. For this measurement, for example, a dynamic light scattering particle diameter analyzer ELS-Z (manufactured by Otsuka Electronics) may be used.

Also, the average primary particle diameter of the alumina particles may be in the range of 20 nm to 100 nm, such as in the range of 20 nm to 80 nm. The use of alumina particles having such an average primary particle diameter facilitates the production of the recording medium having a surface roughness Ra in the range of 30 nm to 150 nm.

The average primary particle diameter of the alumina particles may be measured by observation under a transmission electron microscope (TEM) or a scanning electron microscope (SEM).

(2) Inorganic Particles Other than the Alumina Particles

The ink-receiving layer may contain inorganic particles other than the alumina particles within limits not impeding the effects of the present invention. Examples of inorganic particles other than the alumina particles include silica particles.

Binder

The ink-receiving layer contains a binder. The binder mainly contains a water-insoluble resin. The term binder used herein refers to a material that can bind inorganic particles together to form a coating film. The water-insoluble resin used herein refers to a resin that can remain 95% by mass or more without being dissolved when immersed in hot water of 80° C. for 2 hours.

The water-insoluble resin may be at least one selected from the group consisting of acrylic resin, polycarbonate-modified urethane resin, and polyether-modified urethane resin from the viewpoint of water resistance.

The resins that can be used as the water-insoluble resin will now be described.

(1) Acrylic Resin

The acrylic resin used herein refers to a polymer of one or more (meth)acrylic esters. The polymer may be a homopolymer or a copolymer as long as one or more (meth)acrylic esters are used as a monomer.

Exemplary acrylic esters include methyl acrylate, ethyl acrylate, butyl acrylate, 2-ethylhexyl acrylate, 2-dimethylaminoethyl acrylate, 2-hydroxyethyl acrylate, 2-hydroxypropyl acrylate, 2-hydroxybutyl acrylate, isobutyl acrylate, octyl acrylate, lauryl acrylate, and stearyl acrylate. Exemplary methacrylic esters include methyl methacrylate, ethyl methacrylate, butyl methacrylate, 2-ethylhexyl methacrylate, 2-dimethylaminoethyl methacrylate, 2-hydroxyethyl methacrylate, 2-hydroxypropyl methacrylate, 2-hydroxybutyl methacrylate, isobutyl methacrylate, octyl methacrylate, lauryl methacrylate, and stearyl methacrylate. These monomers may be copolymerized with another monomer. The monomer that can be copolymerized with one or more (meth)acrylic esters may be a vinyl-based monomer. Examples of the vinyl-based monomer include styrene and styrene derivatives, such as vinyl toluene, vinylbenzoic acid, α-methylstyrene, p-hydroxymethylstyrene, and styrenesulfonic acid; vi ethers and derivatives thereof, such as methyl vinyl ether, butyl vinyl ether, methoxyethyl vinyl ether, N-vinylpyrrolidone, 2-vinyl oxazoline, and vinylsulfonic acid.

In some embodiments, the acrylic resin may be a poly(acrylic ester), a poly(methacrylic ester), or a copolymer of an acrylic ester and a methacrylic ester. In an embodiment, a copolymer of a methacrylic ester having a relatively high glass transition temperature and an acrylic ester having a relatively low glass transition temperature may be used because the glass transition temperature of the finished acrylic resin can be controlled by the proportion of the methacrylic ester and the acrylic ester.

(2) Urethane Resin (Polycarbonate-Modified Urethane Resin, Polyether-Modified Urethane Resin)

The urethane resin used herein refers to a resin having a urethane bond. If the binder contains a urethane resin, the urethane resin is at least one selected from the group consisting of polycarbonate-modified urethane resins and polyether-modified urethane resins. Polycarbonate-modified urethane resins and polyether-modified urethane resins may be integrally referred to as urethane resin.

More specifically, the urethane resin may be produced by a reaction of polyisocyanate and polyol with a chain extending agent. Examples of the polyisocyanate include aromatic isocyanates, such as tolylene diisocyanate, diphenylmethane diisocyanate, polymeric diphenylmethane diisocyanate, tolidine diisocyanate, naphthalene diisocyanate, xylylene diisocyanate, and tetramethylxylylene diisocyanate; and aliphatic or alicyclic isocyanates, such as hexamethylene diisocyanate, trimethylhexamethylene diisocyanate, and isophorone diisocyanate. Examples of the polyol include polyether-based polyols, such as polypropylene glycol, polyethylene glycol, and polytetramethylene glycol; and polycarbonate-based polyols, such as palyhexamethylene carbonate. The chain extending agent may be a compound having active hydrogen, and example thereof include low-molecular-weight glycols, such as ethylene glycol, low-molecular-weight diamines, and low-molecular-weight amino alcohols. These may be used singly or in combination.

The proportion of the water-insoluble resin in the ink-receiving layer may be in the range of 30% by mass to 90% by mass relative to the inorganic particles in the ink-receiving layer.

The ink-receiving layer may further contain a water-soluble resin as another binder. The water-soluble resin may be polyvinyl alcohol, polyvinyl pyrrolidone, or water-soluble cellulose. Beneficially, the ink-receiving layer does not contain any water-soluble resin. If a water-soluble resin is contained, it is beneficial that the proportion thereof to the water-insoluble resin is 25% by mass or less. The proportion of the water-soluble resin to the water-insoluble resin in the ink-receiving layer may be calculated from the amounts of materials used for producing the recording medium, or according to the following procedure.

First, 1.0 g of the ink-receiving layer is scraped from the recording medium and placed in 1,000 g or more of hot water of 80° C., followed by stirring. Subsequently, the liquid is filtered, and the solids are dried. The dried solids are weighed (X g). The value calculated by 10 (g)−X (g) is defined as the content of the water-soluble resin in 10 g of the scraped ink-receiving layer.

Then, the X g of the dried solids are heated at 600° C. for 2 hours, and the remaining solids are weighed (Y a). The value calculated by X (g)−Y (g) is defined as the content of the water-insoluble resin in 10 g of the scraped ink-receiving layer.

The proportion of the water-soluble resin to the water-insoluble resin is thus determined by the calculation (10 (g)−X g)/(X (g)−Y (g)).

Also, the proportion of the water-insoluble resin to the inorganic particles is determined by (X (g)−Y (g))/Y (g).

The glass transition temperature Tg of the water-insoluble resin may be 20° C. or less. The water-insoluble resin having a glass transition temperature of 20° C. or less can enhance the binding force between the water-insoluble resin and the inorganic particles and thus increase water resistance. The glass transition temperature of the water-insoluble resin may be measured by differential scanning calorimetry (DSC).

Other Ingredients

The ink receiving layer may further contain other ingredients or additives unless the advantageous effects of the present disclosure are reduced. Examples of such ingredients or additives include a crosslinking agent, a pH adjuster, a thickener, a fluidity improving agent, an antifoaming agent, a foam suppressor, a surfactant, a release agent, a penetrant, a coloring pigment, a coloring dye, a fluorescent brightening agent, an ultraviolet absorbent, an antioxidant, a preservative, a fungicide, a water-resistant additive, an ink fixing agent, a curing agent, and a tough material.

Examples of the crosslinking agent include aldehyde-based compounds, melamine compounds, isocyanate-based compounds, zirconium-based compounds, titanium-based compounds, amide-based compounds, aluminum-based compounds, boric acid and salts thereof, carbodiimide-based compounds, and oxazoline-based compounds.

The ink fixing agent may be a cationic resin other than the above-described acrylic resin and urethane resin, or a multivalent metal salt.

Examples of the cationic resin include polyethyleneimine resin, polyamine resin, polyamide resin, polyamide-epichlorohydrin resin, polyamine-epichlorohydrin resin, polyamide polyamine epichlorohydrin resin, polydiallylamine resin, and dicyandiamide condensates. Examples of the multivalent metal salt include calcium compounds, magnesium compounds, zirconium compounds, titanium compounds, and aluminum compounds. In an embodiment, a calcium compound, such as calcium nitrate tetrahydrate, may be used as the multivalent metal salt.

Method for Manufacturing Recording Medium

Although the recording medium of the present disclosure may be produced by any method without particular limitation, the method may include preparing a coating liquid for the ink receiving layer, and applying the coating liquid onto the substrate. The method for manufacturing the recording medium will now be described.

The ink receiving layer may be formed on the substrate according to the following procedure. First, a coating liquid for the ink receiving layer is prepared. Then, the coating liquid is applied onto the substrate and is then dried to yield the recording medium. The coating liquid may be applied with, for example, a roll coater, a blade coater, a bar coater, an air knife coater, a gravure coater, a reverse coater, a transfer coater, a die coater, kiss coater, a rod coater, a curtain coater, an extrusion coater, or a slide hopper coater. The coating liquid may be heated during being applied.

Before applying the coating liquid, a surface-treating liquid containing a surface-treating agent may be applied onto the surface of the substrate to be coated with the coating liquid. This surface treatment increases the wettability of the coating liquid on the substrate, thus increasing the adhesion between the ink-receiving layer and the substrate. Examples of the surface-treating agent include thermoplastic resins, such as acrylic resin, polyurethane resin, polyester resin, polyethylene resin, polyvinyl chloride resin, polypropylene resin, polyimide resin, and styrene-butadiene copolymer, and silane coupling agents. These may be used singly or in combination. The surface-treating liquid may further contain inorganic particles unless the advantageous effects of the present disclosure are reduced. The above-described inorganic particles may be added. For drying the applied coating liquid, a hot air dryer may be used, such as a linear tunnel dryer, an arch dryer, an air loop dryer, or a sine curve air float dryer. A dryer using IR radiation or microwaves may be used.

Image Recording Method

The image recording method according to an embodiment of the present disclosure is a method for recording images on a recording medium by ejecting ink from a recording head and is often called ink jet recording method.

The ink may be ejected by applying a mechanical energy to the ink or by applying a thermal energy to the ink. The recording method disclosed herein is performed in a well-known manner except that aqueous pigment ink is ejected onto the ink t recording medium according to an embodiment of the present disclosure.

Aqueous Pigment Ink

The aqueous pigment ink contains water and a pigment and may further contain a water-soluble organic solvent and other ingredients as needed. For example, the aqueous pigment ink may contain a viscosity modifier, a pH adjuster, a preservative, a surfactant, an antioxidant, and/or any other additive as needed.

The water used in the aqueous pigment ink may be deionized water or ion exchanged water. The water content in the aqueous pigment ink may be in the range of 50.0% by mass to 95.0% by mass relative to the total mass of the ink. The water-soluble organic solvent content in the aqueous pigment ink may be in the range of 3.0% by mass to 50.0% by mass relative to the total mass of the ink.

The pigment may be selected from known pigments. The pigment may have an average particle diameter in the range of 50 nm to 180 nm. The pigment having such an average particle diameter are more likely to accumulate on the surface of the recording medium and unlikely to flake from the recording medium.

As described above, the present disclosure provides an ink jet recording medium exhibiting high ink absorption, enabling high color development, having a high water resistance, and reducing flaking of pigment and to a method for recording an image on the ink jet recording medium.

EXAMPLES

The subject matter of the present disclosure will be further described in detail with reference to Examples and Comparative Examples. The subject matter is however not limited to the following Examples. In the following Examples, "part(s)" is on a mass basis unless otherwise specified.

Production of Recording Media

Preparation of Substrate

New YUPO FCS 110 (manufactured by Yupo Corporation), which is a polypropylene-based synthetic paper, was used as the substrate.

Preparation of Inorganic Particle Dispersion Liquids

Inorganic Particle Dispersion Liquids 1 to 9

Water and a dispersant were weighed out so that the inorganic particle dispersion liquid could have the inorganic particle content (solid content) and the dispersant content shown in Table 1, and inorganic particles were then added to the mixture of water and the dispersant that was being stirred with a mixer. The inorganic particles after being added were stirred with a mixer for 30 minutes. Inorganic particle dispersion liquids 1 to 9 were thus prepared.

The average particle diameter of the inorganic particles was measured as below.

Each of inorganic particle dispersion liquids 1 to 9 was diluted to a solids content of 1% to yield a measurement sample. The average particle diameter of the inorganic particles of inorganic particle dispersion liquids 1 to 5 and 7 to 9 was measured with a dynamic light scattering particle diameter analyzer ELS-Z (manufactured by Otsuka. Electronics). For inorganic particle dispersion liquid 6, the average particle diameter was measured with a particle diameter distribution analyzer based on a laser diffraction method, SALD-2300 (manufactured by Shimadzu), because the inorganic particles Sylysia 440 have a large particle diameter,

TABLE 1

| | Inorganic particles | | | | Dispersant | |
|---|---|---|---|---|---|---|
| | Type | Product name | Content in dispersion liquid (mass %) | Average particle diameter | Name | Proportion to inorganic particles (mass basis) |
| Inorganic particle dispersion liquid 1 | Alumina particles | Disperal HP22 (Produced by Sarol) | 23.0 | 170 nm | Metasulfonic acid (produced by Kishida Chemical) | 0.8 |
| Inorganic particle dispersion liquid 2 | Alumina particles | Disperal HP30 (Produced by Sarol) | 23.0 | 180 nm | Metasulfonic acid (produced by Kishida Chemical) | 0.5 |
| Inorganic particle dispersion liquid 3 | Alumina particles | Disperal HP40 (Produced by Sarol) | 23.0 | 245 nm | Metasulfonic acid (produced by Kishida Chemical) | 0.5 |
| Inorganic particle dispersion liquid 4 | Alumina particles | Disperal HP60 (Produced by Sarol) | 23.0 | 280 nm | Metasulfonic acid (produced by Kishida Chemical) | 0.5 |
| Inorganic particle dispersion liquid 5 | Alumina particles | Disperal HP80 (Produced by Sarol) | 23.0 | 540 nm | Metasulfonic acid (produced by Kishida Chemical) | 0.5 |
| Inorganic particle dispersion liquid 6 | Silica particles | Sylysia 440 (produced by Fuji Silysia Chemical) | 20.0 | 5 μm | — | — |
| Inorganic particle dispersion liquid 7 | Alumina particles | Disperal HP15 (Produced by Sarol) | 20.0 | 150 nm | Metasulfonic acid (produced by Kishida Chemical) | 1.2 |
| Inorganic particle dispersion liquid 8 | Alumina particles | Disperal HP18 (Produced by Sarol) | 20.0 | 155 nm | Metasulfonic acid (produced by Kishida Chemical) | 1.0 |
| Inorganic particle dispersion liquid 9 | Silica particles | Aerosil 300 (produced by Aerosil) | 18.0 | 120 nm | Polydiallyldimethylamine (Shallol DC-902P produced by DKS) | 4.0 |

Coating Liquids 1 to 22 for Ink-Receiving Layer

A water-insoluble resin and/or a water-soluble resin was added to inorganic particle dispersion liquids 1 to 9 according to Table 2. Furthermore, benzotriazole ultraviolet light absorbent was added in a proportion of 3.0 parts to 100 parts of the inorganic particles. The resulting mixture was adjusted to a solids content of 20% with pure water to yield each of coating liquids 1 to 22. The average particle diameter (50% average particle diameter measured by a light scattering method) of the water-insoluble resin in each of the coating liquids 1 to 22 shown in Table 2 is as follows:

Mowinyl 7820 (produced by Nippon Gohsei, average particle diameter: 350 nm)

WLS 210 (produced by DIC, average particle diameter: 50 nm)

WLS 201 (produced by DIC, average particle diameter: 50 nm)

SUPERFLEX 620 (produced by Dai-ichi Kogyo Seiyaku, particle diameter: 200 nm)

Mowinyl 7720 (produced by Nippon Gohsei, average particle diameter: 350 nm)

TABLE 2

| | | Binder | | | | | |
|---|---|---|---|---|---|---|---|
| | | Water-insoluble resin | | | Water-soluble resin | | |
| Coating liquid | Inorganic particle dispersion liquid | Type | Product name | Proportion to 100 parts of inorganic particles (parts by mass) | Type | Product name | Proportion to 100 parts of inorganic particles (parts by mass) |
| Coating liquid 1 | Inorganic particle dispersion liquid 1 | Acrylic resin | Mowinyl 7820 (Nippon Gohsei) | 67 | — | — | — |
| Coating liquid 2 | Inorganic particle dispersion liquid 1 | Acrylic resin | Mowinyl 7820 (Nippon Gohsei) | 58 | — | — | — |
| Coating liquid 3 | Inorganic particle dispersion liquid 1 | Polycarbonate-modified urethan resin | WLS210 (DIC) | 50 | — | — | — |
| Coating liquid 4 | Inorganic particle dispersion liquid 1 | Polyether-modified urethan resin | WLS201 (DIC) | 50 | — | — | — |
| Coating liquid 5 | Inorganic particle dispersion liquid 2 | Acrylic resin | Mowinyl 7820 (Nippon Gohsei) | 58 | — | — | — |
| Coating liquid 6 | Inorganic particle dispersion liquid 2 | Acrylic resin | Mowinyl 7820 (Nippon Gohsei) | 50 | — | — | — |
| Coating liquid 7 | Inorganic particle dispersion liquid 3 | Acrylic resin | Mowinyl 7820 (Nippon Gohsei) | 50 | — | — | — |
| Coating liquid 8 | Inorganic particle dispersion liquid 4 | Acrylic resin | Mowinyl 7820 (Nippon Gohsei) | 50 | — | — | — |
| Coating liquid 9 | Inorganic particle dispersion liquid 5 | Acrylic resin | Mowinyl 7820 (Nippon Gohsei) | 50 | — | — | — |
| Coating liquid 10 | Inorganic particle dispersion liquid 2 | Acrylic resin | Mowinyl 7820 (Nippon Gohsei) | 28 | — | — | — |
| Coating liquid 11 | Inorganic particle dispersion liquid 2 | Acrylic resin | Mowinyl 7820 (Nippon Gohsei) | 30 | — | — | — |

TABLE 2-continued

| | | Binder | | | | | |
|---|---|---|---|---|---|---|---|
| | | Water-insoluble resin | | | Water-soluble resin | | |
| Coating liquid | Inorganic particle dispersion liquid | Type | Product name | Proportion to 100 parts of inorganic particles (parts by mass) | Type | Product name | Proportion to 100 parts of inorganic particles (parts by mass) |
| Coating liquid 12 | Inorganic particle dispersion liquid 2 | Acrylic resin | Mowinyl 7820 (Nippon Gohsei) | 90 | — | — | — |
| Coating liquid 13 | Inorganic particle dispersion liquid 2 | Acrylic resin | Mowinyl 7820 (Nippon Gohsei) | 95 | — | — | — |
| Coating liquid 14 | Inorganic particle dispersion liquid 2 | Acrylic resin | Mowinyl 7820 (Nippon Gohsei) | 50 | Polyvinyl alcohol | PVA235 (Kuraray) | 10 |
| Coating liquid 15 | Inorganic particle dispersion liquid 2 | Acrylic resin | Mowinyl 7820 (Nippon Gohsei) | 50 | Polyvinyl alcohol | PVA235 (Kuraray) | 8 |
| Coating liquid 16 | Inorganic particle dispersion liquid 2 | Polyester-modified polyurethane resin | SUPERFLEX 620 (DKS) | 50 | — | — | — |
| Coating liquid 17 | Inorganic particle dispersion liquid 8 | Acrylic resin | Mowinyl 7820 (Nippon Gohsei) | 58 | — | — | — |
| Coating liquid 18 | Inorganic particle dispersion liquid 6 | Acrylic resin | Mowinyl 7720 (Nippon Gohsei) | 58 | — | — | — |
| Coating liquid 19 | Inorganic particle dispersion liquid 7 | Acrylic resin | Mowinyl 7820 (Nippon Gohsei) | 58 | — | — | — |
| Coating liquid 20 | Inorganic particle dispersion liquid 2 | — | — | — | Polyvinyl alcohol | PVA235 (Kuraray) | 12 |
| Coating liquid 21 | Inorganic particle dispersion liquid 9 | Acrylic resin | Mowinyl 7820 (Nippon Gohsei) | 35 | — | — | — |
| Coating liquid 22 | Inorganic particle dispersion liquid 2 | Acrylic resin | Mowinyl 7820 (Nippon Gohsei) | 105 | — | — | — |

Recording Media of Examples 1 to 18 and Comparative Examples 1 to 5

Each of coating liquids 1 to 22 was applied onto the substrate prepared above with a bar coater so that the ink-receiving layer could have the thickness shown in Table 3. The coating was dried with hot air of 115° C. to yield each of recording media 1 to 23 of Examples 1 to 18 and Comparative Examples 1 to 5.

The resulting recording media were subjected to measurements for the surface roughness Ra and the thickness of the ink-receiving layer and the number of depressions having a circle equivalent diameter in the range of 240 nm to 800 nm in the surface of the recording medium by the methods described below. The results are shown in Table 3. Also, ink absorbency, color development, water resistance, and flaking of pigment were examined according to the procedures described below. The results are shown in Table 4. For recording medium 22, since the ink-receiving layer cracked, the following examinations were not performed.

Measurement of Surface Roughness Ra with Scanning Probe Microscope

The surface roughness Ra of the uppermost ink-receiving layer was measured with a scanning probe microscope (SPM) L-trace II (manufactured by Hitachi High-Tech Science). The measurement uses the atomic force between the sample and the probe and can bring information of nanometer-order very small surface roughness of the ink-receiving layer. Table 3 shows the results.

The measurement was performed under the following conditions:

Measurement mode: Dynamic force mode (DFM)

Cantilever: SI-DF40 (K-A102002760), Al-coated rear side (resonance frequency: 352 kHz, spring constant: 47 N/m)

Scanning area: 5 μm×5 μm

Measurement of Surface Roughness with Stylus Surface Roughness Tester

For reference, the surface roughness Ra of the ink-receiving layer was measured with a stylus surface roughness meter used mainly for micrometer-order surface roughness Ra under the following conditions:

Tester: Surfcorder SE3500 manufactured by Kosaka Laboratory

Measurement: the cutoff value was determined according to JTS B0601: 2001, and the length of 5 times of the cutoff value was measured.

Measurement of Thickness of Ink-Receiving Layer

A section of the recording medium was exposed by cutting with a microtome, and the thickness of the ink-receiving layer was measured under a scanning electron microscope SU-70 (manufactured by Hitachi).

Figure 2:
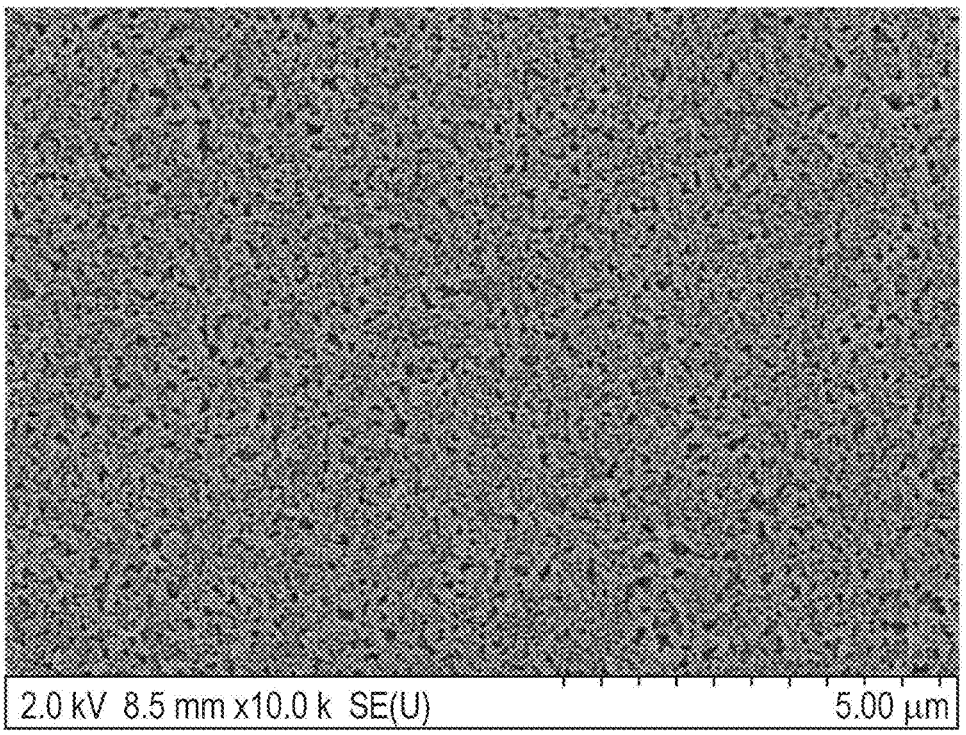
FIG. 2 is a micrograph of the surface of recording medium 21 in Comparative Example 3, taken by a scanning electron microscope.

Measurement of Number of Depressions Having Circle Equivalent Diameter of 240 nm to 800 nm in the Surface of Recording Medium A photograph of the surface of the recording medium was taken with a scanning electron microscope SU-70 (manufactured by Hitachi) under the following conditions:

Signal Name: SE (U, LA80)
Accelerating Voltage: 2000 V
Working Distance: 8000 μm
Lens Mode: Normal-Small-Low
Condenser 1: 6000
Scan Speed: Capture_Slow (40)
Magnification: 10000 (used for measurement)
Data Size: 1280×960
Color Mode: Gray scale
Specimen Bias: 0 V FIGS. 1 and 2 show photographic images of the surfaces of recording medium 7 used in Example 7 and recording medium 21 used in Comparative Example 3, respectively, taken with a scanning electron microscope.

The image processing and analysis of the images taken with the scanning electron microscope will now be described.

First, the taken images were converted into 256-gradation images by the "Auto contrast" function of Photoshop (produced by Adobe Systems). The 256-gradation images were binarized with a threshold of 128 gradations to obtain image data discriminating between depressions (represented by black) and the other portion (represented by white) at the surface of the recording media. Subsequently, the number diameter distribution of the circle equivalent diameter of the depressions was obtained from the image data with an image analysis/measurement software program WinROOF 2015 (produced by Mitani Corporation). Then, the number of depressions having a circle equivalent diameter in the range of 240 nm to 800 nm per unit area was calculated from the number diameter distribution with a Spreadsheet EXCEL 2016 (produced by Microsoft).

The number of depressions having a circle equivalent diameter in this range was measured according to the following procedure:

1. Input the image data into WinROOF 2015.
2. Select "flip" of "image processing" to flip black and white of the image so that the depressions are represented as white.
3. Select "Single Threshold Binarization" of "Binarization" to determine the region of depressions to be measured.
4. Select "Isolated Point Removal" of "Binarization" to remove noise.
5. Select "Circular Shape Separation" of "Binarization" and identify overlapped depressions separately.
6. Select "shape characteristics" of "Measurement" and calculate the radius of each depression.
7. Select "Frequency Distribution" of "Report" to output the number particle diameter distribution data of the radium of depressions.
8. Convert the radiuses in the number particle diameter distribution to diameters with a spreadsheet program EXCEL 2016 and calculate the number of depressions having a diameter in the range of 240 nm to 800 nm to determine the number of depressions per unit area.

It will now be described how to determine the average particle diameter of the pigment in the ink used in the examination described below.

Measurement of Average Particle Diameter of Pigment in Ink

The average particle diameter of the pigment in the ink was measured with a dynamic light scattering particle diameter distribution analyzer (Nanotrac UPA-EX150, manufactured by Nikkiso). The average particle diameter obtained in this measurement is the particle diameter at 50% in the cumulative distribution, $D_{50}$ (nm), of pigment particle diameter. The $D_{50}$ value in the pigment particle diameter distribution is the average value on a volume basis (volume average particle diameter).

Measurement of Ink Absorbency

A solid pattern was recorded with a cyan ink on the recording media with an ink jet recording apparatus imagePROGRAF Pro 4000 (manufactured by Canon) charged with an aqueous pigment in a recording mode of water-resistant poster synthetic paper standard. Then, the recorded solid pattern was visually observed for examining the degree of ink drying after recording and excessive spread of the ink in the recorded pattern. The results were rated according to the criteria below. The recording was performed at a temperature of 23° C. and a humidity of 50%. The average particle diameter of the pigment used as the coloring material in the ink was in the range of 50 nm to 180 nm. Table 4 shows the examination results.

A: The ink was dried very well immediately after recording, and excessive spread of ink was not observed at all.

B: The degree of ink drying after recording decreased to some extent, and the ink was dried 5 seconds after recording. Excessive spread was hardly observed.

C: The degree of ink drying after recording decreased, and the ink was not dried even 10 seconds after recording. Excessive spread was also observed.

D: The degree of ink drying after recording was bad, and the ink was not dried even 15 seconds after recording. Excessive spread was markedly observed.

Measurement of Color Development

A solid pattern was recorded with a black ink on the recording media with an ink jet recording apparatus imagePROGRAF Pro 4000 (manufactured by Canon) charged with an aqueous pigment in a recording mode of water-resistant poster synthetic paper standard. The recorded solid pattern was allowed to stand overnight, and then the optical density (OD) was measured with an optical reflection densitometer (530 Spectrodensitometer, manufactured by X-Rite). The recording was performed at a temperature of 23° C. and a humidity of 50%. The average particle diameter of the pigment used as the coloring material in the ink was in the range of 50 nm to 180 nm. Table 4 shows the examination results.

A: Black pattern had an OD of 2.40 or more.

B: Black pattern had an OD in the range of 2.00 to less than 2.40.

C: Black pattern had an OD in the range of 1.60 to less than 2.00.

D: Black pattern had an OD of less than 1.60.

Measurement of Water Resistance

Running water of 80° C. was allowed to flow on the surface of the recording medium for 24 hours, followed by drying overnight. Then, black construction paper of New Color R series (manufacture by Lintec) was pressed on the surface of the recording medium on the ink-receiving layer side with a load of 75 g/cm$^2$ and reciprocally moved 20 times with a Gakushin-type rubbing tester, AB-301 COLOR FASTNESS RUBBING TESTER (manufactured by Tester Sangyo). Optical density of the surface of the black paper on the side pressed on the recording medium was measured before and after the test with an optical reflection densitometer (500 Spectrodensitometer, manufactured by X-Rite). A larger change in optical density suggests that a larger amount of a portion removed from the ink-receiving layer was attached to the black paper, and hence suggests that the water resistance of the recording medium is low. The results were rated according to the following criteria: The results are shown in Table 4.

A: Change in optical density was less than 20%.

B: Change in optical density was in the range of 20% to less than 30%.

C: Change in optical density was in the range of 30% to less than 40%.

D: Change in optical density was 40% or more.

Flaking of Pigment

A patch pattern with RGB values of (255, 255, 160) was recorded on the recording medium with an ink jet recording apparatus imagePROGRAF Pro 4000 (manufactured by Canon) in a recording mode of water-resistant poster synthetic paper standard. The recorded pattern was dried for 24 hours. Then, the optical density of the recorded pattern was measured with an optical reflection densitometer (530 Spectrodensitometer, manufactured by X-Rite).

Furthermore, the patch pattern recorded on the recording medium was exposed to outdoor conditions in accordance with ISO 18930 in Xenon weather meter Ci4000 (manufactured by Atlas) for 200 hours for image stability test and, then, the optical density of the patch pattern was measured again. The change in optical density was calculated by the following equation:

Change in optical density (%)={(optical density after exposure)/(optical density before exposure)}×100

The xenon weather meter was operated under conditions: light wavelength, 340 nm; irradiation intensity, 0.39 $W/m^{-2}$; chamber temperature, 50° C.; relative humidity, 70%; rack temperature, 63° C. The image stability test under the outdoor conditions in accordance with ISO 18930 is a test simulating the conditions, including sunlight and rain, where recorded articles for outdoor display are generally placed.

A larger change in optical density suggests that the recording medium can produce a higher effect to reduce the flaking of pigment. The flaking of pigment was rated according to the following criteria. It should be noted that the average particle diameter of the pigment used as the coloring material in the ink was in the range of 50 nm to 180 nm. The results are shown in Table 4.

AA: Change in optical density was 80% or more.

A: Change in optical density was in the range of 70% to less than 80%.

B: Change in optical density was in the range of 60% to less than 70%.

C: Change in optical density was in the range of 50% to less that: 60%.

D: Change in optical density was less than 50%.

TABLE 3

| Example | Recording medium | Coating liquid | Ink-receiving layer thickness (μm) | Number of depressions of 240 nm to 800 nm (/100 $\mu m^2$) | SPM-measured surface roughness Ra (nm) | Reference value Surface roughness Ra measured with stylus surface roughness tester (μm) |
|---|---|---|---|---|---|---|
| Example 1 | Recording medium 1 | Coating liquid 1 | 40 | 185 | 42 | 0.27 |
| Example 2 | Recording medium 2 | Coating liquid 2 | 40 | 154 | 48 | 0.26 |
| Example 3 | Recording medium 3 | Coating liquid 3 | 40 | 52 | 48 | 0.29 |
| Example 4 | Recording medium 4 | Coating liquid 4 | 40 | 55 | 48 | 0.29 |
| Example 5 | Recording medium 5 | Coating liquid 5 | 25 | 201 | 56 | 0.30 |
| Example 6 | Recording medium 6 | Coating liquid 5 | 23 | 198 | 56 | 0.29 |
| Example 7 | Recording medium 7 | Coating liquid 6 | 40 | 188 | 60 | 0.28 |
| Example 8 | Recording medium 8 | Coating liquid 7 | 40 | 175 | 80 | 0.27 |
| Example 9 | Recording medium 9 | Coating liquid 8 | 40 | 185 | 115 | 0.28 |
| Example 10 | Recording medium 10 | Coating liquid 9 | 40 | 180 | 145 | 0.31 |
| Example 11 | Recording medium 11 | Coating liquid 10 | 40 | 101 | 60 | 0.27 |
| Example 12 | Recording medium 12 | Coating liquid 11 | 40 | 110 | 60 | 0.28 |
| Example 13 | Recording medium 13 | Coating liquid 12 | 40 | 225 | 52 | 0.28 |
| Example 14 | Recording medium 14 | Coating liquid 13 | 40 | 230 | 48 | 0.27 |
| Example 15 | Recording medium 15 | Coating liquid 14 | 40 | 180 | 55 | 0.29 |
| Example 16 | Recording medium 16 | Coating liquid 15 | 40 | 185 | 55 | 0.28 |
| Example 17 | Recording medium 17 | Coating liquid 16 | 40 | 60 | 56 | 0.29 |
| Example 18 | Recording medium 18 | Coating liquid 17 | 40 | 145 | 37 | 0.28 |
| Comparative Example 1 | Recording medium 19 | Coating liquid 18 | 40 | — | >200 | 0.95 |
| Comparative Example 2 | Recording medium 20 | Coating liquid 19 | 40 | 120 | 23 | 0.29 |
| Comparative Example 3 | Recording medium 21 | Coating liquid 20 | 40 | 26 | 52 | 0.29 |
| Comparative Example 4 | Recording medium 22 | Coating liquid 21 | 40 | — | — | — |
| Comparative Example 5 | Recording medium 23 | Coating liquid 22 | 40 | 260 | 48 | 0.28 |

TABLE 4

| Example | Recording medium | Color development | Ink absorbency | Water resistance | Degree of flaking |
|---|---|---|---|---|---|
| Example 1 | Recording medium 1 | A | B | A | B |
| Example 2 | Recording medium 2 | A | A | A | A |
| Example 3 | Recording medium 3 | A | C | A | A |
| Example 4 | Recording medium 4 | A | C | A | A |
| Example 5 | Recording medium 5 | A | B | A | A |
| Example 6 | Recording medium 6 | A | C | A | A |
| Example 7 | Recording medium 7 | A | A | A | AA |
| Example 8 | Recording medium 8 | B | B | A | AA |
| Example 9 | Recording medium 9 | C | B | A | AA |
| Example 10 | Recording medium 10 | C | B | A | AA |
| Example 11 | Recording medium 11 | A | A | B | B |
| Example 12 | Recording medium 12 | A | A | B | A |
| Example 13 | Recording medium 13 | A | B | A | A |
| Example 14 | Recording medium 14 | A | C | A | A |
| Example 15 | Recording medium 15 | A | A | C | B |
| Example 16 | Recording medium 16 | A | A | B | A |
| Example 17 | Recording medium 17 | A | A | C | A |
| Example 18 | Recording medium 18 | A | A | A | C |

TABLE 4-continued

| Example | Recording medium | Color development | Ink absorbency | Water resistance | Degree of flaking |
|---|---|---|---|---|---|
| Comparative Example 1 | Recording medium 19 | D | A | A | AA |
| Comparative Example 2 | Recording medium 20 | A | A | A | D |
| Comparative Example 3 | Recording medium 21 | A | A | D | D |
| Comparative Example 4 | Recording medium 22 | Ink-receiving layer cracked. | | | |
| Comparative Example 5 | Recording medium 23 | A | D | A | B |

As shown in Table 3, the surface roughness measured with SPM have slight variations among the samples even though the surface roughnesses measured with a stylus surface roughness tester are almost the same. Table 4 suggests that a very small difference in surface roughness detected by SPM is involved in the flaking of pigment, color development, and other properties.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-063413 filed Mar. 28, 2017, which is hereby incorporated by reference herein in its entirety.

What is claimed is:

1. An ink jet recording medium comprising:

a substrate; and an ink-receiving layer being the uppermost surface layer, wherein the ink-receiving layer contains:

a binder mainly containing a water-insoluble resin, and inorganic particles mainly including alumina particles, wherein the content of the inorganic particles is 50% by mass or more relative to the total mass of the ink-receiving layer, wherein the surface roughness (Ra) of the ink-receiving layer measured with a scanning probe microscope is in the range of 30 nm to 150 nm, wherein a surface of the recording medium has depressions represented by black when an image of the surface of the recording medium taken with a scanning electron microscope is binarized, and wherein a number of depressions having a circle equivalent diameter in the range of 240 nm to 800 nm per unit area of 100 $\mu m^2$ of the surface of the recording medium is 50 to 300.

2. The ink jet recording medium according to claim 1, wherein the ink-receiving layer contains a water-soluble resin with a proportion of 0% to 25% by mass relative to the water-insoluble resin.

3. The ink jet recording medium according to claim 1, wherein the water-insoluble resin is at least one selected from the group consisting of acrylic resin, polycarbonate-modified urethane resin, and polyether-modified urethane resin.

4. The ink jet recording medium according to claim 1, wherein the proportion of the water-insoluble resin in the ink-receiving layer is in the range of 30% by mass to 90% by mass relative to the mass of the inorganic particles in the ink-receiving layer.

5. The ink jet recording medium according to claim 1, wherein the ink-receiving layer has a thickness of 25 μm or more.

6. The ink jet recording medium according to claim 1, wherein the alumina particles have an average particle diameter in the range of 155 nm to 560 nm.

7. The ink jet recording medium according to claim 1, wherein the ink-receiving layer has a thickness in the range of 25 μm to 50 μm.

8. The ink jet recording medium according to claim 1, wherein the alumina particles have an average particle diameter in the range of 170 nm to 250 nm.

9. The ink jet recording medium according to of claim 1, wherein the surface roughness (Ra) of the ink-receiving layer measured with a scanning probe microscope is in the range of 40 nm to 100 nm.

10. The ink jet recording medium according to claim 1, wherein the alumina particles are hydrated alumina.

11. The ink jet recording medium according to claim 1, wherein the content of the inorganic particles is in the range of 50% to 98% by mass or less relative to the total mass of the ink-receiving layer.

12. The ink jet recording medium according to claim 1, wherein the substrate is a resin-coated substrate, a plastic film, or a cloth sheet.

13. An image recording method comprising:

ejecting an aqueous pigment ink containing a pigment onto an ink jet recording medium from a recording head, wherein the ink jet recording medium comprises:

a substrate; and an ink-receiving layer being the uppermost surface layer, wherein the ink-receiving layer contains:

a binder mainly containing a water-insoluble resin, and inorganic particles mainly including alumina particles, wherein the content of the inorganic particles is 50% by mass or more relative to the total mass of the ink-receiving layer, wherein the surface roughness (Ra) of the ink-receiving layer measured with a scanning probe microscope is in the range of 30 nm to 150 nm, wherein a surface of the recording medium has depressions represented by black when an image of the surface of the recording medium taken with a scanning electron microscope is binarized, and wherein a number of depressions having a circle equivalent diameter in the range of 240 nm to 800 nm per unit area of 100 $\mu m^2$ of the surface of the recording medium is 50 to 300.

14. The image recording method according to claim 13, wherein the pigment has an average particle diameter in the range of 50 nm to 180 nm.

* * * * *